United States Patent [19]

Woodle

[11] 4,311,583

[45] Jan. 19, 1982

[54] SOLVENT EXTRACTION PROCESS

[75] Inventor: Robert A. Woodle, Nederland, Tex.

[73] Assignee: Texaco, Inc., White Plains, N.Y.

[21] Appl. No.: 125,034

[22] Filed: Feb. 27, 1980

[51] Int. Cl.[3] ..... C10G 21/20

[52] U.S. Cl. ..... 208/312; 208/326

[58] Field of Search ..... 208/312, 321, 322, 326, 208/327, , 335

[56] References Cited

U.S. PATENT DOCUMENTS

| | | | |
|---|---|---|---|
| 2,106,234 | 1/1938 | Bray | 208/320 X |
| 2,846,354 | 8/1958 | Holm et al. | 208/335 X |
| 2,886,523 | 5/1959 | Claridge et al. | 208/312 |
| 3,306,849 | 2/1967 | Bozeman et al. | 208/314 |
| 3,476,681 | 11/1969 | Davies et al. | 208/326 |
| 4,057,491 | 11/1977 | Bushnell et al. | 208/321 |

*Primary Examiner*—Delbert E. Gantz
*Assistant Examiner*—William Leader
*Attorney, Agent, or Firm*—Carl G. Ries; Robert A. Kulason; George J. Darsa

[57] ABSTRACT

A solvent refining process utilizing N-methyl-2-pyrrolidone as solvent in which primary extract from the extraction zone is cooled to form a secondary raffinate and secondary extract and the secondary and primary raffinates are blended to produce an increased yield of product of desired quality. In a preferred embodiment of the process, the lubricating oil feedstock to the process is first contacted with a stripping medium previously used in the process for the recovery of solvent from at least one of the product streams whereby solvent contained in said stripping medium is recovered therefrom.

9 Claims, 1 Drawing Figure

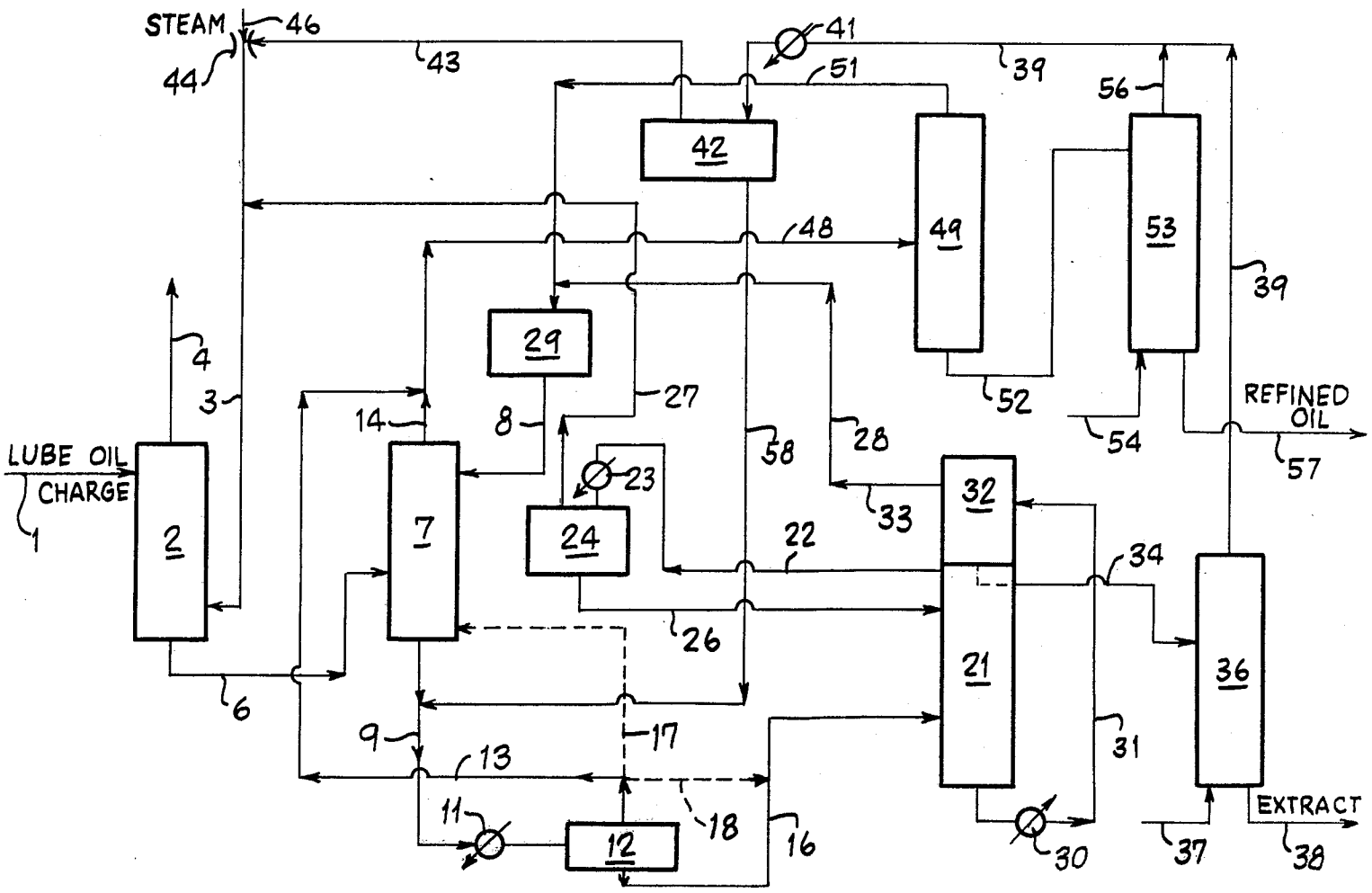
REFINED OIL
EXTRACT
STEAM
LUBE OIL CHARGE
1
2
3
4
6
7
8
9
11
12
13
14
16
17
18
21
22
23
24
26
27
28
29
30
31
32
33
34
36
37
38
39
41
42
43
44
46
48
49
51
52
53
54
56
57
58

SOLVENT EXTRACTION PROCESS

The invention relates to an improved process for the solvent extraction of a petroleum oil fraction containing aromatic and non-aromatic constituents. In one of its more specific aspects, the invention relates to a method for improving the refined oil yield in a lubricating oil solvent refining process utilizing N-methyl-2-pyrrolidone as a solvent.

It is well known that aromatic and unsaturated hydrocarbons contained in lubricating oil base stocks derived from crude petroleum may be separated from the more saturated hydrocarbon components by various processes involving solvent extraction of the aromatic and unsaturated hydrocarbons. The extraction of unwanted constituents from lubricating oil base stocks with N-methyl-2-pyrrolidone (NMP) as a solvent has increased significantly in commercial importance in the past several years. Removal of aromatics and other undesirable constituents from lubricating oil base stocks by treatment with N-methyl-2-pyrrolidone improves the viscosity index, color, oxidative stability, thermal stability, and inhibition response of the base oil and of the ultimate lubricating oil products made therefrom.

The advantages of N-methyl-2-pyrrolidone as a lubricating oil extraction solvent for the removal of undesirable aromatic and polar constituents from petroleum based lubricating oil stocks is now well recognized by refiners. Some refiners have converted their lubricating oil refining facilities from other solvents, such as phenol or furfural, to N-methyl-2-pyrrolidone because of the advantages which result from this particular solvent. Some of these advantages are referred to, for example, in U.S. Pat. No. 4,057,491. Some of the prior art processes employing N-methyl-2-pyrrolidone as solvent and illustrating conventional solvent recovery operations are disclosed in U.S. Pat. Nos. 3,461,066 and 3,470,089.

In conventional lubricating oil refining with N-methyl-2-pyrrolidone, as applied to charge stocks from Mid-Continent or similar mixed base crude oils, the solvent extraction step is carried out under conditions effective to recover about 30 to 90 volume percent of the lubricating oil charge as raffinate or refined oil and to extract about 10 to 70 volume percent of the charge as an aromatic extract. The lubricating oil stock is contacted in an extraction zone with solvent at a temperature at least 10° C., preferably at least 50° C., below the temperature of complete miscibility of the lubricating oil stock in the solvent.

In the solvent extraction zone, the lubricating oil feedstock and solvent are contacted with one another in an extraction tower in which the solvent and lubricating oil stock are brought into intimate liquid-liquid contact with one another. The extraction tower may comprise a packed, baffled, or sieve tray tower with or without mechanical agitation, such as rotating disk or centrifugal contacting devices. Two liquid phases are present in the solvent extraction tower; one is an extract phase containing the major amount of the solvent together with dissolved aromatic components of the charge stock and the other a raffinate phase containing non-aromatic components of the charge stock together with a minor amount of solvent.

Operating conditions are selected to produce a primary raffinate having a dewaxed viscosity index of about 85 to 100, and preferably about 90 to 96. When N-methyl-2-pyrrolidone is employed as solvent in the refining of lubricating oil feedstocks, solvent extraction temperatures within the range of 60° to 100° C. (140° to 212° F.), preferably within the range of 65° to 95° C. (150° to 205° F.), are employed with solvent dosages within the range of 100 to 500 percent, i.e., 100 to 500 volumes of solvent for each 100 volumes of oil feedstock; preferably, solvent dosages are within the range of 150 to 400 percent.

The operation of the extraction tower involves counterflow of the two immiscible liquid phases. Therefore, the mechanical feasibility of the process depends on a significant density difference between the solvent-rich phase, or extract phase, and the oil-rich phase, or raffinate phase. Within the solvent dosage range of 100 to 500 percent, i.e., 100 to 500 volumes of solvent to each 100 volumes of lubricating oil feedstock, the density difference increases with increased solvent dosage. At very low solvent dosages, for example, less than 100 percent, the density difference can become so low as to severely limit the throughput of feed to the solvent extraction tower.

N-methyl-2-pyrrolidone is such an effective solvent for aromatics that in the case of some hydrocarbon charge stocks the solvent dosage needed to produce the desired raffinate quality is impractically low. When operating an extraction tower with dry NMP at the minimum practical dosage, i.e., about 100 percent, and temperature, i.e., about 60° C. (140° F.), the refined oil quality is higher than desired and in some cases the refined oil yield is lower than desired.

The process of the invention overcomes this problem by operating the extraction step at a solvent dosage effective for rapid separation of the two liquid phases within the extraction tower, generating a secondary raffinate and secondary extract by cooling the primary extract, optionally with the addition of water or wet solvent, separating a secondary raffinate from the secondary extract and combining at least a part of the secondary raffinate with the primary raffinate to obtain the desired quality raffinate product with a high yield of refined oil.

It has been proposed heretofore to add water to the NMP in the extraction tower to reduce its solubility for the aromatic hydrocarbons. The present invention provides a process in which dry solvent may be used in the extraction tower and at the same time an increased yield of refined oil at a given solvent dosage obtained. The solvent recovery may be simplified with a resultant savings in energy requirements of the process.

The process of the invention will be more readily understood by reference to the accompanying drawing and the following detailed description of a preferred embodiment of the process.

The FIGURE is a simplified flow diagram of a preferred embodiment of the process of the invention.

With reference to the FIGURE, petroleum base lubricating oil feedstock is supplied to the solvent refining process through line 1 into the upper part of an absorber tower 2 wherein the lubricating oil feedstock is brought into intimate countercurrent contact with a mixture of stripping medium, e.g., steam or inert gas, and solvent vapors entering the lower part of absorber 2 through line 3.

The absorber comprises a countercurrent contacting tower which may be provided with packing material, perforated plates, bubble trays, cascade trays, or the like, to insure intimate contact between vapors entering the lower part of the tower through line 3 and the charge stock entering the upper part of the tower through line 1. In the absorber 2, solvent vapors are absorbed in the lubricating oil feedstock and the recovered solvent returned with the feedstock to the process. Stripping medium, from which solvent has been removed, is discharged through line 4 to waste or reuse in the process.

The lubricating oil charge stock, preheated by the stripping medium and containing recovered solvent is passed from absorber 2 through line 6 to the lower part of extraction tower 7 wherein the lubricating oil feedstock from line 6 is intimately countercurrently contacted with dry N-methyl-2-pyrrolidone solvent introduced into the upper part of the extraction tower 7 through line 8.

Extract containing the major portion of the solvent is withdrawn from the bottom of extraction tower 7 through line 9 to cooler 11 where the extract mixture is cooled to a temperature below the outlet temperature of the extraction zone 7 by an amount sufficient to form two immiscible liquid phases, a secondary extract phase and a secondary raffinate phase. The secondary extract phase, relatively richer in aromatic hydrocarbons than the primary extract withdrawn from extraction tower 7 through line 9, and the secondary raffinate phase, relatively poorer in aromatic hydrocarbons than the primary extract phase, are separated from one another in a gravity settler or decanter 12.

The secondary raffinate from decanter 12 is passed through line 13 into admixture with primary raffinate withdrawn from the upper part of extraction tower 7 through line 14. A part of the secondary raffinate may be returned to the lower part of extraction zone 7 through line 17, or passed through line 18 into admixture with secondary extract withdrawn from the lower part of decanter 12 through line 16, as required, to control the quantity and quality of the raffinate (refined oil) product from the process.

Secondary extract withdrawn from the bottom of settler 12 is passed through line 16 to a flash tower 21. Solvent vapors are taken overhead from tower 21 through line 22 and passed to cooler 23 wherein they are condensed and the condensate collected in reflux accumulator 24. Reflux for the distillation column is supplied to the column 21 from the reflux accumulator through line 26. Uncondensed gases and vapors from separator 24 are passed through line 27 to absorber 2 via line 3. Distillation column 21 is suitably maintained at a pressure within the range of 10 to 15 psig (170 to 205 kPa). A mixture of solvent and extract is withdrawn from the bottom of tower 21 and passed through heater 30 and line 31 to a flash distillation tower 32, suitably maintained at a pressure within the range of 40 to 45 psig (375 to 415 kPa) wherein further separation of solvent from the extract takes place. Solvent separated from the extract in flash tower 32 is passed through lines 33 and 28 to solvent accumulator 29 for reuse in the process.

Extract containing a small amount of solvent is withdrawn from the bottom of flash tower 32 through line 34 to stripping tower 36. In stripping tower 36, solvent remaining in the extract is separated from the extract by stripping with a suitable stripping medium, e.g., steam or inert gas. The total pressure in stripping tower 36 is suitably at atmospheric pressure or lower (e.g., 1 to 100 kPa). In this example, stripping medium is introduced into the lower part of stripping tower 36 through line 37 while product extract, typically containing less than about 5 parts per million solvent by weight, is discharged from the system through line 38.

Stripping medium, e.g., inert gas or steam, containing solvent vapors passes overhead from stripping tower 36 through line 39 to a cooler 41 which condenses solvent and water vapor. A wet solvent condensate is accumulated in accumulator 42 for reuse in the process. The wet solvent condensate may be dehydrated or partially dehydrated, if desired, prior to reuse in the process in any conventional manner, not illustrated. Uncondensed vapors are withdrawn from accumulator 42 through line 43 by a steam eductor 44 to which steam is supplied through line 46 to produce a subatmospheric pressure in accumulator 42. Steam from the eductor and uncondensed gases and vapors from accumulator 42, including solvent vapors, are passed via line 3 to absorber tower 2.

The primary raffinate leaving extraction tower 7 through line 14 is admixed with secondary raffinate leaving separator 12 through line 13 and the mixture of primary and secondary raffinates passed through line 48 to a flash tower 49, preferably maintained at subatmospheric pressure, wherein the major portion of the solvent contained in the raffinate mixture is separated from the raffinate. Separation of solvent from the raffinate is facilitated by the use of pressures within the range of about 5 pounds per square inch absolute up to atmospheric pressure (about 10 to about 100 kPa) and preferably about 11 psia (about 76 kPa). Solvent separated from the raffinate in flash tower 49 is passed through line 51 to solvent accumulator 29 for reuse in the process.

The bottoms from flash tower 49 pass through line 52 to a stripper tower 53 preferably maintained at subatmospheric pressure, suitably at a pressure in the range of 1 to 100 kPa. Steam, or other suitable stripping medium, is introduced into the lower part of stripping tower 53 through line 54. Stripping medium and solvent vapors leaving the top of stripping tower 53 pass through line 56 into line 39 to condenser 41. The resulting condensed solvent is collected in solvent accumulator 42 for reuse in the process.

Solvent refined oil, i.e., raffinate from which the solvent has been removed, is discharged from the system through line 57. Typically, the refined oil contains less than about 5 ppm solvent.

Dry solvent, typically containing not more than 1 weight percent water is supplied to extraction tower 7 from solvent accumulator 29 as the solvent for the extraction of aromatic compounds from the feedstock. With steam as the stripping medium, wet solvent is collected in solvent accumulator 42, and may be passed through line 58 to line 9 where it is mixed with primary extract from extraction tower 7 to assist in the separation of a secondary raffinate from the extract. It is to be understood that the secondary raffinate phase may be formed by simply cooling the primary extract, by the addition of water to the extract mixture, or by the combined action of cooling the extract and dilution of the solvent with water. Water or wet solvent from any suitable source may be supplied through line 58 to line 9.

Some of the advantages of the process of this invention will be evident from the following examples.

EXAMPLE 1

In a series of test runs, the process of the invention is compared with conventional solvent refining with N-methyl-2-pyrrolidone as the selective solvent. In Runs 1 to 6, a light lubricating oil feedstock distillate (PD-10) is processed to produce a refined oil of a quality corresponding to a refractive index at 70° C. ($RI_{70}$) of 1.4615 to yield a dewaxed oil stock having a viscosity index of 84. The feedstock is processed under the conditions and with the results indicated in Table I. In Runs 1–3, the lube oil feedstock is processed in the conventional manner. In Runs 4 and 5, a secondary raffinate is separated from the primary extract by cooling primary extract from the contactor bottom temperature of 70° C. (160° F.) to 60° C. (140° F.) and decanting the raffinate phase from the extract phase. The two raffinates are blended and stripped of solvent to form the combined raffinate product.

TABLE I

| | Conventional | | | This Process | |
|---|---|---|---|---|---|
| Run No. | 1 | 2 | 3 | 4 | 5 |
| Dosage, V. % | 103 | 202 | 318 | 200 | 300 |
| Contactor Btm, °C. | 60 | 60 | 60 | 70 | 70 |
| Extract Out, °C. | 60 | 60 | 60 | 60 | 60 |
| $RI_{70}$ Refined Oil | 1.4574 | 1.4536 | 1.4519 | 1.4575 | 1.4620 |
| $RI_{70}$ Extract | 1.5143 | 1.5056 | 1.5046 | 1.5056 | 1.5046 |
| Yield, Vol. % | 71.7 | 61.7 | 59.0 | 66.7 | 72.9 |

It will be evident from the data in Table I that when a solvent dosage of about 100 volume percent is employed (Run 1) the product is over refined, with a refractive index at 70° C. of 1.4574. Increasing the solvent dosage (Runs 2 and 3) progressively increases the quality of the refined oil, as indicated by the refractive index values, and reduces the yield of the solvent refined oil product. By the process of this invention, the refined oil yield at a solvent dosage of 200 volume percent is increased by 5 volume percent (Run 4 compared with Run 2), and at 300 volume percent, the refined oil yield is increased 13.9 volume percent (Run 5 compared with Run 3). Product from Run 5 meets the refined oil product specification of an $RI_{70}$ of 1.4615.

EXAMPLE 2

In a series of runs, a wax distillate (WD-40) is treated with N-methyl-2-pyrrolidone as solvent in a series of runs (Runs 6 to 10) under the conditions and with the results shown in Table II. In this series, the desired refined oil quality to produce a dewaxed oil stock having a viscosity index of about 65 corresponds to a refractive index at 70° C. of about 1.4800.

TABLE II

| | Minimum Conventional | | | This Process | |
|---|---|---|---|---|---|
| Run No. | 6 | 7 | 8 | 9 | 10 |
| Dosage, V. % | 108 | 299 | 403 | 300 | 400 |
| Contactor Btm, °C. | 80 | 80 | 80 | 90 | 90 |
| Extract Out, °C. | 80 | 80 | 80 | 80 | 80 |
| $RI_{70}$ Refined Oil | 1.4700 | 1.4616 | 1.4590 | 1.4688 | 1.4790 |
| $RI_{70}$ Refined Oil | 1.5350 | 1.5120 | 1.5070 | 1.5120 | 1.5070 |
| Yield, Vol. % | 70.8 | 45.6 | 37.5 | 53.3 | 64.2 |

It can be seen from the above table that a minimum solvent dosage of about 100 volume percent (Run 6) if employed in conventional processing of this stock would result in a high yield of over refined product, the product having a refractive index of 1.4700. Increasing the solvent dosage in the conventional refining sequence to 300 or 400 volume percent (Runs 7 and 8) decreases the refractive index of the refined oil and reduces the refined oil yield. Lower solvent dosages are capable of producing higher yields of refined oil exceeding product specifications, as indicated by Run 6, but are not practical in many commercial continuous countercurrent contacting systems for the reasons already mentioned.

Runs 9 and 10 are carried out at the higher solvent dosages in accordance with the process of this invention. In these runs, the secondary raffinate is separated from the primary extract by cooling the primary extract from 90° C. (200° F.) to 80° C. (180° F.) and decanting the raffinate phase from the extract phase. After separation from the secondary extract, the secondary raffinate is blended with the primary raffinate to produce the refined oil product. By using the process of this invention, a yield of 53.3 volume percent is obtained with a solvent dosage of 300 volume percent (Run 9) as compared with a yield of 45.6 volume percent (Run 7) with conventional processing of this lube oil stock. By increasing the solvent dosage to 400 volume percent, (Run 10), the desired quality product is produced and the yield of product is increased by the process of this invention to 64.2 volume percent. Increasing the solvent dosage to 400 volume percent in conventional processing (Run 8) decreases the yield of product.

I claim:

1. In a process for solvent refining a lubricating oil feedstock wherein said lubricating oil feedstock is contacted with N-methyl-2-pyrrolidone as a selective solvent for aromatic constituents of said feedstock in an extraction zone thereby forming a raffinate phase comprising a minor amount of said solvent and an extract phase comprising a major amount of said solvent, said raffinate phase is separated from said extract phase and solvent is removed from each of said phases, the improvement which comprises cooling said extract phase to a temperature below the temperature in said extraction zone by an amount sufficient to form two immiscible liquid phases comprising a secondary extract phase richer in aromatic hydrocarbons than said primary extract and a secondary raffinate phase poorer in aromatic hydrocarbons than said primary extract, and combining said primary raffinate with said secondary raffinate prior to the separation of solvent therefrom.

2. A process according to claim 1 wherein said solvent dosage in said extraction zone is within the range of 100 to 400 volumes of solvent per 100 volumes of lubricating oil feedstock.

3. A process according to claim 1 wherein said N-methyl-2-pyrrolidone supplied to said extraction zone is substantially free from water, and water is added to said primary extract prior to said cooling step to provide a mixture containing 1 to 10 weight percent water.

4. A process according to claim 3 wherein said water is supplied by wet N-methyl-2-pyrrolidone added to said primary extract.

5. A process according to claim 4 wherein a portion of said solvent substantially free from water is recovered from said secondary extract and returned to said extraction zone as solvent therefor.

6. A process according to claim 5 wherein water vapor admixed with solvent vapors is separated from said secondary extract in a distillation zone and passed into intimate contact with fresh lubricating oil charge stock in an absorption zone wherein solvent vapors are absorbed in said lubricating oil charge stock, and said lubricating oil charge stock containing recovered solvent is supplied to said extraction zone as the lubricating oil feedstock to said process.

7. A process according to claim 6 in which said secondary extract is subsequently contacted with a gaseous stripping agent in a stripping zone under conditions effective for the substantially complete removal of water and solvent from said secondary extract forming a mixture of stripping agent and solvent vapors containing water, and said mixture containing solvent vapors and water vapor is cooled to condense a portion of said solvent vapors therefrom prior to passing uncondensed solvent and stripping agent into contact with said fresh lubricating oil charge stock in said absorption zone.

8. A process according to claim 7 wherein said stripping agent is an inert gas.

9. A process according to claim 1 wherein said stripping agent is steam and a mixture of water and solvent condensed from said steam and solvent vapors from said stripping zone is admixed with said primary extract prior to said cooling to produce said secondary extract and secondary raffinate.

* * * * *